US005241741A

United States Patent [19]

Sugaya

[11] Patent Number: 5,241,741

[45] Date of Patent: Sep. 7, 1993

[54] METHOD OF MAKING A POSITIVE TEMPERATURE COEFFICIENT DEVICE

[75] Inventor: Shoich Sugaya, Tokyo, Japan

[73] Assignee: Daito Communication Apparatus Co., Ltd., Tokyo, Japan

[21] Appl. No.: 912,145

[22] Filed: Jul. 10, 1992

[30] Foreign Application Priority Data

Jul. 12, 1991 [JP] Japan ..... 3-172754

[51] Int. Cl.[5] ..... H01C 7/02

[52] U.S. Cl. ..... 29/612; 29/621; 338/22 R

[58] Field of Search ..... 29/612, 621; 338/22 R

[56] References Cited

U.S. PATENT DOCUMENTS 3,934,058 1/1976 Seebacher ..... 29/612
4,426,633 1/1984 Taylor ..... 29/612
4,818,439 4/1989 Blackledge et al. ..... 264/105

*Primary Examiner*—P. W. Echols
*Attorney, Agent, or Firm*—Thomas R. Morrison

[57] ABSTRACT

A positive temperature coefficient ("PTC") device body is formed by compression molding of an organic PTC composition consisting of a crystalline polymer with conductive particles dispersed therein. The body is sandwiched between electrodes to which terminals are attached by spot welding or soldering. The PTC device body is aged at normal pressure and at a temperature higher than the peak resistance temperature, that is, the temperature at which its resistance is a maximum, and lower than 250° C. The resistance of the PTC device does not change either before or after exposure to high temperatures, that is, temperatures substantially greater than 250° C., and the PTC characteristics of the device do not decrease despite aging. Therefore PTC devices made according to the present invention can be surface-mounted.

11 Claims, 3 Drawing Sheets

METHOD OF MAKING A POSITIVE TEMPERATURE COEFFICIENT DEVICE

BACKGROUND OF THE INVENTION

This invention relates to positive temperature coefficient (hereinafter "PTC") devices or circuit elements, especially to those that can be surface mounted.

PTC devices whose coefficient of resistance substantially increases when the temperature reaches a certain range are widely used to protect electronic devices from overcurrent. These devices are conventionally made from polymers into which a conductive material is mixed. The PTC device is formed by compression molding and crosslinking the polymers with radiation.

Such a device may not show constant resistance under normal working conditions. Therefore, as described, for example, in Japanese Laid-Open Patent Publications Nos. 95203/1980, 165203/1981 and 218117/1986, additional steps can be carried out during the manufacture of PTC devices to improve the constancy of their resistance. One such step is to raise the temperature of the PTC device above the melting point of its polymer base. This rise in temperature maintains the PTC device's resistance constant under normal working conditions.

According to Japanese Laid-Open Patent Publication No. 95203/1980, thermally treating a PTC device for 10–20 minutes at 150°–200° C. and thereafter cooling it at least twice causes the resistance of the conductive polymer to reach a stable value.

According to Japanese Laid-Open Patent Publication No. 165203/1981, a PTC device of constant resistance can be made by annealing for a sufficient length of time at either the melting point of the polymer or a higher temperature.

According to Japanese Laid-Open Patent Publication No. 218117/1986, a PTC device showing constant resistance under high voltage can be made by the successive steps of (1) crosslinking the polymer with ionizing radiation, (2) applying heat at a temperature above the melting point of the polymer, and (3) crosslinking again with radiation or other means.

One of the methods most commonly used to surface-mount an electronic part to a substrate is soldering. Soldering can be divided into two categories: dipping in a bath of solder and reflow soldering. Either method exposes the part to be soldered to high temperature. Therefore EIAJ Standard RCX-0102/102 requires parts that will be surface mounted to maintain their thermal durability under either of the following conditions: (1) for the dipping method, dipping for 5±0.5 seconds at 260° C.±0.5° C.; or (2) for the vapor phase solder bath method, immersion for 30±1 seconds after the temperature has reached 240° C.±5° C.

However, these standard temperatures are both above the melting point of high-density polyethylene (approximately 130° C.), which is the polymer of choice for making a polymer-type PTC device. Hence the resistance at room temperature of a conventional PTC device formed by compression molding increases excessively because of the high temperature applied during surface mounting. Such an excessive resistance makes surface mounting of conventional PTC devices practically impossible.

The PTC devices disclosed in Japanese Laid-Open Patent Publication No. 95203/1980, produced by heating to a temperature above the melting point of the polymer, cannot be readily used to protect against overcurrents because of their high volume-resistivity. The PTC devices disclosed in Japanese Laid-Open Patent Publication No. 165203/1981 are expensive to produce because a minimum of three hours is necessary for annealing. Furthermore, the body of a PTC device is formed by extrusion, and annealing reduces its resistance.

The PTC devices disclosed in Japanese Laid-Open Patent Publication No. 218117/1986 are probably effective as overcurrent protection elements. However, there is no disclosure in that Patent Publication that these devices may be surface mounted, nor is any highest temperature specified for thermal treatment of PTC devices.

OBJECTS AND SUMMARY OF THE INVENTION

An object of the present invention is to provide a PTC device that has both constant resistance at room temperature and low volume-resistivity.

A further object of the present invention is to provide a PTC device which can be produced rapidly and economically.

Still a further object of the present invention is to provide a PTC device that can be surface mounted.

Briefly stated, a positive temperature coefficient ("PTC") device body is formed by compression molding of an organic PTC composition consisting of a crystalline polymer with conductive particles dispersed therein. The body is sandwiched between electrodes to which terminals are attached by spot welding or soldering. The PTC device body is aged at normal pressure and at a temperature higher than the peak resistance temperature, that is, the temperature at which its resistance is a maximum, and lower than 250° C. The resistance of the PTC device does not change either before or after exposure to high temperatures, that is, temperatures substantially greater than 250° C., and the PTC characteristics of the device do not decrease despite aging. Therefore PTC devices made according to the present invention can be surface-mounted.

According to an embodiment of the invention, a PTC device comprises: a body formed by heating and pressure-molding an organic composition having positive temperature coefficient characteristics; the organic composition comprising at least one crystalline polymer and a plurality of conductive particles dispersed therein; the body being aged under normal pressure at a temperature no lower than a temperature where the body reaches its highest value of resistance and no higher than 250° C.; the body having attached thereto an upper and a lower electrode; and at least one terminal being connected to each of the upper and the lower electrodes.

The above, and other objects, features, and advantages of the present invention will become apparent from the following description read in conjunction with the accompanying drawings, in which like reference numerals designate the same elements.

DETAILED DESCRIPTION OF THE PREFERRED EMBODIMENT

Figure 1:
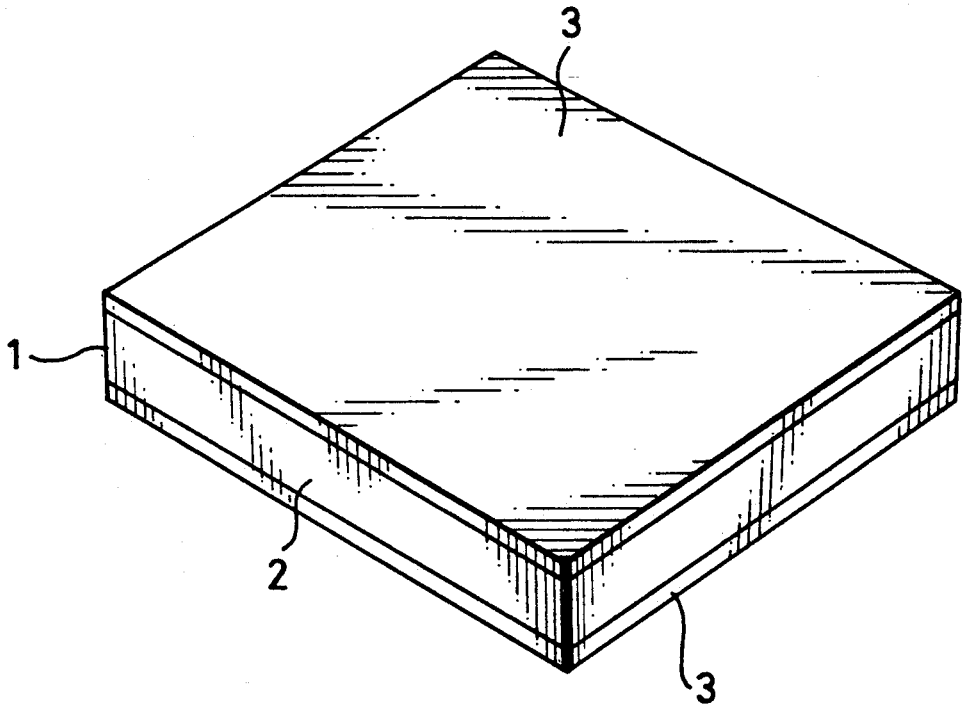
FIG. 1 is an oblique view of a PTC device according to an embodiment of the present invention.

Referring to FIG. 1, a body 1 of a PTC device is produced from an organic composition 2 consisting of a crystalline polymer and a plurality of conductive particles dispersed therein. Organic composition 2, which has a positive temperature coefficient, is sandwiched between electrodes 3 made of metal foil and formed into a specified shape by heat and pressure. After crosslinking the crystalline polymer with radiation or electron beams, body 1 is punched out in a specified shape.

Figure 2:
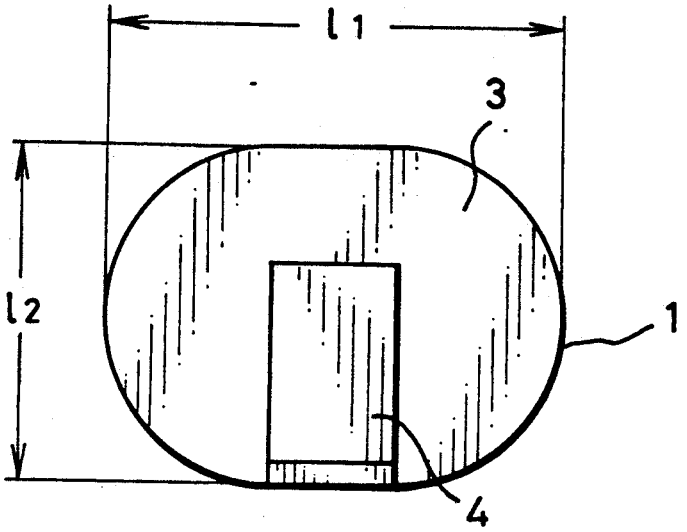
FIG. 2 is a top view of a PTC device, according to an embodiment of the present invention, with terminals attached thereto.
Figure 3:
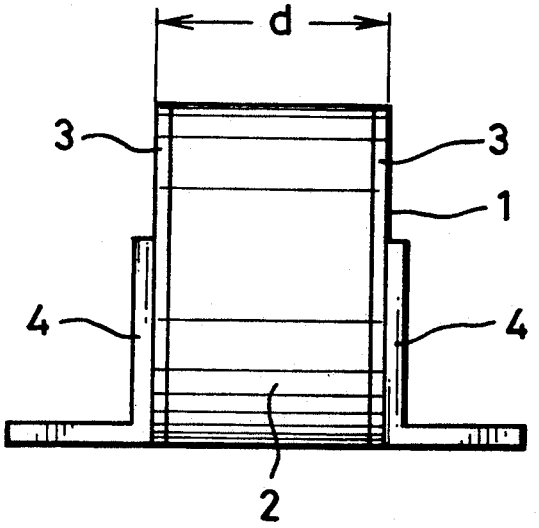
FIG. 3 is a side view of the PTC device shown in FIG. 2.

Referring to FIG. 2, terminals 4 are spot welded, using parallel-gap shaped spot electrodes, or soldered to electrodes 3. Then body 1 is aged by placing it in an environment of normal pressure and appropriate temperature. Appropriate temperature ranges from a peak resistance temperature, where body 1 exhibits its highest resistance, to 250° C. Then body 1 is placed into an outer package (not shown in the drawings) to complete the PTC device.

If it is to be surface mounted, a PTC device is usually limited in size. Thus body 1 must have minimal volume-resistivity to be made as compact as possible. Hence compression molding is widely used to form the body of a PTC device, thereby reducing its volume-resistivity.

In compression molding, an organic PTC composition solidifies after melting under a high pressure. Thus body 1 solidifies, and conductive particles are dispersed in the crystalline polymer of body 1 in a dense condition, thereby reducing the volume resistivity of body 1. Body 1 is then aged by thermal treatment at normal pressure and at a temperature above the melting point of the crystalline polymer. The crystalline polymer melts and resolidifies. At that time, body 1 resolidifies in a less dense condition because it is under lower pressure than at the time of formation. Therefore the conductive particles in the crystalline polymer become less densely distributed than at the time of body 1's formation, resulting in larger volume resistivity.

Even if the crystalline polymer is again melted and re-solidified under normal pressure, the conductive particles in the crystalline polymer have already been distributed under normal pressure. So the positions of the conductive particles after the second melt and solidification under normal pressure are the same as after the first melt and solidification under normal pressure, which means that the volume resistivity of the element also remains the same. Consequently, by melting and solidifying the crystalline polymer to age the PTC device, it is possible after the thermal pressurized formation of body 1 to maintain its volume resistivity constant regardless of what heat may be applied afterwards.

In other words, by heating the crystalline polymer to above its melting point under normal pressure, body 1, which was formed by compression molding, will be released from the stress it underwent when being formed. Thus the volume-resistivity of body 1 can generally be maintained at a constant level even if body 1 is exposed again to a temperature higher than the melting point of the crystalline polymer.

To release rapidly the stress applied at the time of formation of a PTC device, it is preferable to heat the crystalline polymer to a temperature higher than its maximum resistance temperature. The entire crystalline polymer contained in body 1 is thus melted to release the stress.

However, if the PTC device is heated to too high a temperature, the PTC characteristics of the device will decline because of thermal degradation of the crystalline polymer. Therefore it is necessary to set a limit to the temperature to which the device is heated.

By thus heat-aging body 1 after its formation, it is possible to maintain the volume resistivity of the PTC device constant despite any exposure to high temperature to which the PTC device might be subject thereafter.

Furthermore, when body 1 is exposed after its formation to a temperature higher than the melting point of the crystalline polymer, its external shape is sometimes deformed. In order to prevent such deformation, the crystalline polymer must be crosslinked before heating. Crosslinking is performed by irradiating body 1 with electron beams or radiation.

EMBODIMENT 1

Thermal black (brand name: Thermax N-990 Ultra Pure; manufactured by Cancarb Limited) heated in a nitrogen ($N_2$) atmosphere of at 1000° C. for 18 hours provides conductive particles, and polyethylene (brand name: Hi-Zex 1300J; manufactured by Mitsui Petrochemical Industries; melting point: 131° C.) is the crystalline polymer. The thermal black and polyethylene are blended and kneaded at weight ratio of 150:100 respectively in a roll mill at a constant temperature of approximately 140° C. After cooling, the blend is crushed into pellets to form an organic PTC composition. The composition thus produced (0.29 g) is sandwiched between a pair of nickel foils (25$\mu$ thick; manufactured by Fukuda Metal Foil Industries), which serve as electrodes. The composition is compressed in a metal mold into a body with thickness d of approximately 1 mm. The temperature and pressure for this compression molding are respectively 190° C. and 465 kgf/cm$^2$. After this temperature and pressure are maintained for a specified time, the body in the mold is cooled. When the temperature and the pressure are reduced to 50° C. and 116 kgf/cm$^2$ respectively, the body is removed from the metal mold.

The body is aged in a thermostatic oven at 100° C. for 1.5 hours and then cooled. After exposure to 10 Mrad of $\gamma$ rays for crosslinking the crystalline polymer, the body is formed by a punch into an ellipse with a major axis L1 and a minor axis L2 of 2 mm and 1.7 mm respectively.

A terminal (brand name: Cobarl Ribbon; width: 0.5 mm; gold-plated; manufactured by Japan Avionics) is attached to each electrode by spot welding with parallel-gap shaped spot electrodes, thereby forming a PTC device.

The PTC device is aged in a thermostatic oven at 140° C. for 10 minutes.

EMBODIMENT 2

A PTC device is produced in the same manner as Embodiment 1 and placed in a thermostatic oven at 200° C. for 10 minutes for aging.

EMBODIMENT 3

A PTC element is produced in the same manner as Embodiment 1 and aged in a thermostatic oven at 245° C. for five minutes.

COMPARISON EXAMPLE 1

A PTC element is produced in the same manner as Embodiment 1, but no aging treatment is applied.

COMPARISON EXAMPLE 2

Thermal black as conductive particles and polyethylene as crystalline polymer are blended and kneaded at weight ratio of 100:100 respectively in the same manner as in Embodiment 1. After cooling, the blend is crushed into pellets to make an organic PTC composition. A body is formed by compression-molding 0.30 g of composition, and it is sandwiched with the same electrodes. Then, as in Embodiment 1, a PTC device is produced by: aging the body in a thermostatic oven at 100° C. for 1.5 hours; cooling it; irradiating it with 10 Mrad of $\gamma$ rays to crosslink the crystalline polymer; and spot welding terminals to each electrode.

The change in resistance of various PTC devices in relation to exposure to high temperature during surface mounting has been tested in the following manner.

First, the change in resistance from heat during the dipping method of soldering was measured. More precisely, the resistance of each PTC device was measured beforehand. Then, as in actual dipping, the device was dipped in a 260° C. solder bath for five seconds and cooled to room temperature. The resistance was again measured by the four-terminal method, in which one sends a current of 1 mA through both terminals and subtracts the resistance of each terminal from the value obtained to give a final value. The result of this test is shown in Table 1 below.

TABLE 1

| Sample No. | Resistance (Ω) before dipping | Resistance (Ω) after dipping | Volume Resistivity (Ωcm) before dipping | Volume Resistivity (Ωcm) after dipping |
|---|---|---|---|---|
| Embodiment 1 | | | | |
| 1 | 8.9 | 9.7 | 2.3 | 2.6 |
| 2 | 9.6 | 9.5 | 2.5 | 2.5 |
| Embodiment 2 | | | | |
| 3 | 8.9 | 9.1 | 2.3 | 2.4 |
| 4 | 8.8 | 9.8 | 2.3 | 2.6 |
| Embodiment 3 | | | | |
| 5 | 8.1 | 8.3 | 2.1 | 2.2 |
| 6 | 8.4 | 8.3 | 2.2 | 2.2 |
| Comparison Example 2 | | | | |
| 1 | 9.2 | 126 | 2.4 | 33.2 |
| 2 | 9.6 | 119 | 2.5 | 31.3 |

Second, the change in resistance from heat during the re-flow method of soldering was measured. The resistance of each PTC device was measured beforehand. Then, as in actual re-flow soldering, the device was dipped in a 240° C. solder bath for three minutes and cooled to room temperature before measuring the resistance again. The result of this test is shown in Table 2 below.

TABLE 2

| Sample No. | Resistance (Ω) before placing | Resistance (Ω) after placing | Volume Resistivity (Ωcm) before placing | Volume Resistivity (Ωcm) after placing |
|---|---|---|---|---|
| Embodiment 1 | | | | |
| 1 | 9.0 | 8.8 | 2.4 | 2.3 |
| 2 | 9.9 | 9.0 | 2.6 | 2.4 |
| Embodiment 2 | | | | |
| 3 | 8.9 | 9.4 | 2.3 | 2.5 |
| 4 | 8.1 | 8.2 | 2.1 | 2.2 |
| Embodiment 3 | | | | |
| 5 | 8.4 | 8.0 | 2.2 | 2.1 |
| 6 | 8.4 | 8.1 | 2.2 | 2.1 |
| Comparison Example 2 | | | | |
| 1 | 9.2 | 98.6 | 2.4 | 25.9 |
| 2 | 9.8 | 116 | 2.6 | 30.5 |

As shown in Tables 1 and 2, all PTC devices prepared according to Embodiments 1 through 3 exhibited low resistance, i.e., $\sim 10^0$ Qcm, which shows that they are usable as overcurrent protection elements. PTC elements according to Embodiments 1 through 3 showed generally constant resistance values unaffected by the thermal stress of surface mounting. On the other hand, the PTC devices prepared according to Comparison Example 2 showed a strong increase in resistance from thermal exposure at the time of surface mounting.

Third, the change in resistance when the external temperature changed from 20° C. to 150° C. and the PTC characteristic in relation to room temperature was calculated from the change in resistance for each example, according to the following equation. The calculated values are regarded as the PTC characteristic of each device.

$$\text{PTC Characteristic} = \log (R_{150^\circ C.}/R_{20^\circ C.}),$$

where $R_{150^\circ C.}$ is the resistance value of the PTC device when the temperature of the body is 150° C. and $R_{20^\circ C.}$ is the resistance value of the PTC device when the temperature of the body is at room temperature (20° C.).

The result of the test is shown in Table 3 below.

TABLE 3

| | Resistance Ω Room Temperature $R_{20^\circ C.}$ | Resistance Ω 150° C. $R_{150^\circ C.}$ | PTC characteristic |
|---|---|---|---|
| Embodiment 1 | 10.0 | $4.69 \times 10^5$ | 4.7 |
| Embodiment 2 | 7.4 | $1.16 \times 10^5$ | 5.2 |
| Comparison Example 1 | 1.8 | $5.98 \times 10^5$ | 5.5 |

EXAMPLE 1

All the sample PTC elements shown in Table 3 exhibit similar values of the PTC characteristic. PTC characteristics are therefore not affected by aging.

EMBODIMENT 4

Thermal black (brand name: Thermax N-990 Ultra Pure; manufactured by Cancarb Limited) heated in a nitrogen ($N_2$) atmosphere of at 1000° C. for 15 hours provides conductive particles, and polyethylene (brand name: Hi-Zex 3000B; manufactured by Mitsui Petrochemical Industries; melting point: 132° C.) is the crystalline polymer. The thermal black and polyethylene are blended and kneaded at weight ratio of 200:100 respectively in a roll mill at a constant temperature of approximately 160° C. At the time of this thermal blending, organic peroxide, i.e., 2,5-dimethyl-2,5-di(t-butylperoxy) hexyne-3 (brand name: Perhexyne 25B-40; manufactured by Nippon Oil & Fats Co., Ltd.) is added at a proportion of 1.25 g per 100 g of crystalline polymer. After cooling, the blend is crushed into pellets to form an organic PTC composition. The composition thus produced (0.29 g) is compressed, in the same manner as Embodiment 1, in a metal mold and sandwiched by electrodes into a body with thickness d of 1 mm. The PTC device is completed by attaching terminals to each electrode and placed in a thermostatic oven at 150° C. for 20 minutes to age.

EMBODIMENT 5

A PTC device is produced in the same manner as Embodiment 4 and aged in a thermostatic oven at 245° C. for five minutes.

COMPARISON EXAMPLE 3

A PTC element is produced in the same manner as Embodiment 4 and aged in a thermostatic oven at 270° C. for five minutes.

The PTC characteristic was measured for each sample PTC device produced according to Embodiments 4 and 5 and Comparison Example 3. The result of the measurements are shown in Table 4 below.

TABLE 4

| Sample No. | Resistance (Ω) Room Temp. $R_{20° C.}$ | Resistance (Ω) 150° C. $R_{150° C.}$ | PTC Characteristic |
|---|---|---|---|
| Embodiment 4 | | | |
| 1 | 4.96 | $2.93 \times 10^6$ | 5.8 |
| 2 | 4.94 | $6.23 \times 10^6$ | 6.1 |
| Embodiment 5 | | | |
| 3 | 4.93 | $1.86 \times 10^6$ | 5.6 |
| 4 | 5.12 | $1.97 \times 10^6$ | 5.6 |
| Comparison Example 3 | | | |
| 1 | 11.48 | $1.76 \times 10^4$ | 3.2 |
| 2 | 11.71 | $1.14 \times 10^4$ | 3.0 |

As shown in Table 4, the PTC characteristic of the PTC devices of Comparison Example 3, which have been aged at 270° C., is lower than those of PTC elements of Embodiments 4 and 5, which have been aged at 150° C. and 245° C. respectively. Furthermore, that PTC elements of Comparison Example 3 exhibited high resistance at room temperature, which is the normal environmental temperature for PTC elements, indicates that their PTC characteristic declined. Thus 270° C. is too high a temperature for aging.

Figure 4:
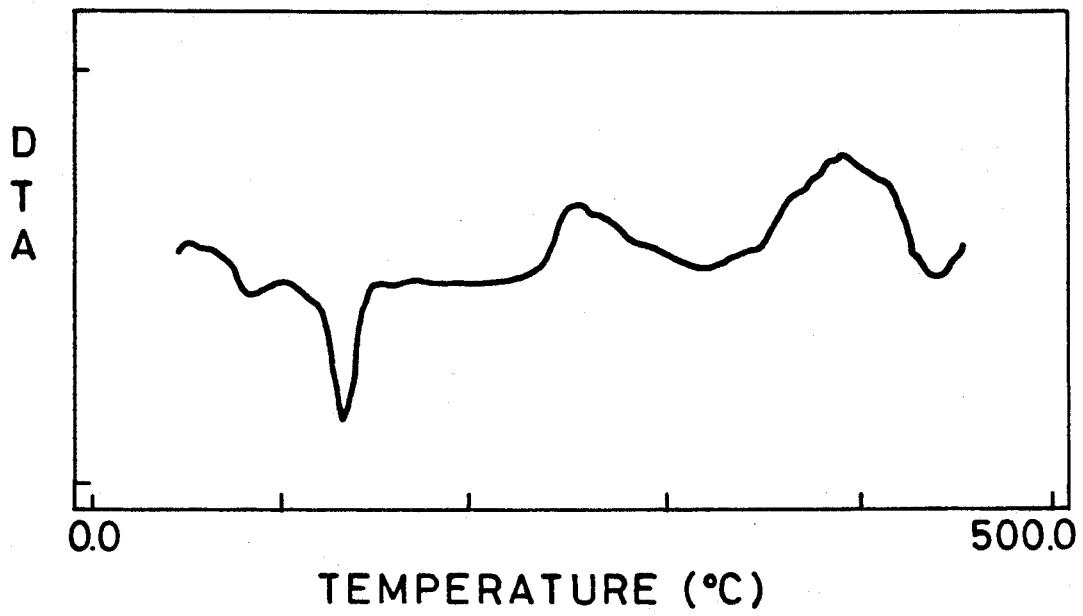
FIG. 4 is a graph showing DTA characteristics of polyethylene (Hi-Zex 3000B; melting point: 132° C.; manufactured by Mitsui Petrochemical Industries).

Referring to FIG. 4, DTA characteristics of the polyethylene (Hi-Zex 3000B with a melting point at 132° C.) that comprises Embodiments 4 and 5 show a peak temperature between 245° C. and 270° C. Thermal degradation of the polyethylene presumably occurred at the peak temperature with alteration of the organic PTC composition and, consequently, decline of PTC capacity.

Figure 5:
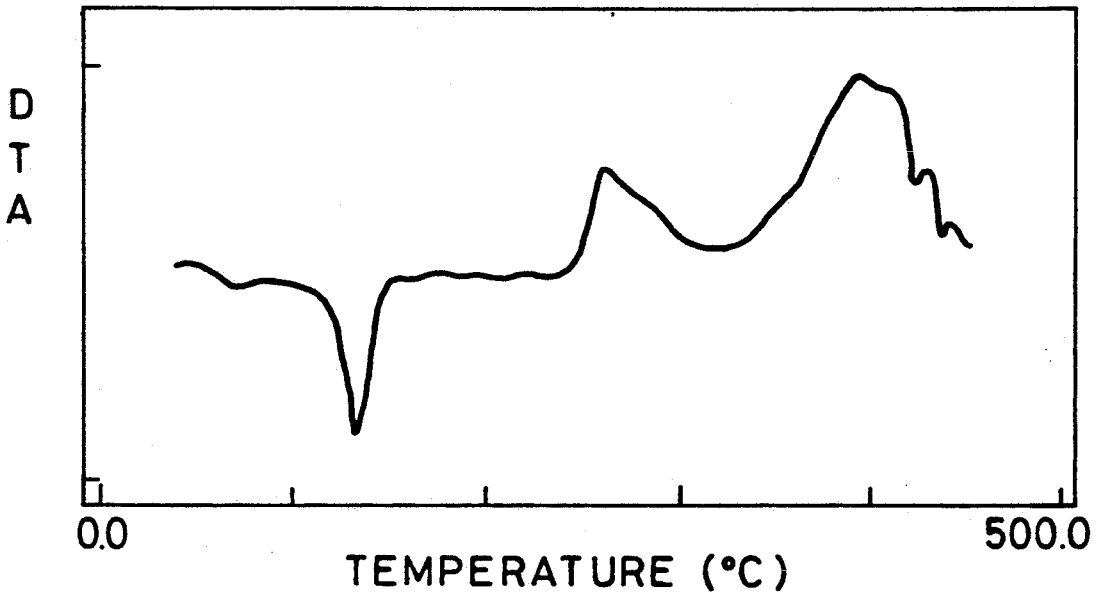
FIG. 5 is a graph showing DTA characteristics of polyethylene (Hi-Zex 1300J; melting point: 131° C.; manufactured by Mitsui Petrochemical Industries).

Referring to FIG. 5, DTA characteristics of the polyethylene (Hi-Zex 1300J with a melting point at 131° C.) that comprises Embodiments 1 through 3 show the same peak temperature between 245° C. and 270° C. as the other polyethylene (Hi-Zex 3000B with the melting point of 132° C.). As aging at a temperature above 250° C. causes the PTC characteristic of devices to decline in value, the highest aging temperature must be set at 250° C.

EMBODIMENT 6

Thermal black (brand name: Thermax N-990 Ultra Pure; manufactured by Cancarb Limited) heated in a nitrogen ($N_2$) atmosphere of at 1000° C. for 13 hours provides conductive particles, and polyethylene (brand name: Hi-Zex 3000B; manufactured by Mitsui Petrochemical Industries; melting point: 132° C.) is the crystalline polymer. The thermal black and polyethylene are blended and kneaded at weight ratio of 200:100 respectively in a roll mill at a constant temperature of approximately 170° C. After cooling, the blend is crushed into pellets to form an organic PTC composition. The composition thus produced (0.27 g) is compressed, in the same manner as Embodiment 1, in a metal mold and sandwiched by electrodes into a body with thickness d of 1.08 mm. The PTC device is completed by attaching terminals to each electrode and aged in a thermostatic oven at 100° C. for 1.5 hours. After cooling, the body is irradiated with 10 Mrad of $\gamma$ rays to crosslink the crystalline polymer and cut into an ellipse with a major axis L1 of 2 mm and a minor axis L2 of 1.7 mm.

Terminals are attached to each electrode by sandwiching both electrodes of the body with terminal materials (CAC-92, solder plated, manufactured by Kobe Steel, Ltd., cut into short strips), and the sandwiched body is dipped in a 360° C. solder bath for 0.5 second to make a PTC device. Solder for this embodiment is high-temperature solder (brand name: #304; manufactured by Sumitomo Metal Industries) with a flux for stainless steel.

After being washed with water, the PTC device is aged in a thermostatic oven at 150° C. for 20 minutes.

COMPARISON EXAMPLE 4

A PTC element provided with electrodes is produced in the same manner as Embodiment 6 and then aged in a thermostatic oven at 100° C. for 1.5 hours. After cooling, the body is irradiated with 10 Mrad of $\gamma$ rays to crosslink the crystalline polymer and cut into an ellipse with a major axis L1 of 2 mm and a minor axis L2 of 1.7 mm.

Production of a PTC device is completed by attaching terminals to each electrode by spot welding using parallel-gap spot electrodes.

The PTC characteristic was measured for each sample PTC device produced according to Embodiment 6 and Comparison Example 4. The results are shown in Table 5 below.

TABLE 5

| Sample No. | Resistance (Ω) Room Temp. $R_{20° C.}$ | Resistance (Ω) 150° C. $R_{150° C.}$ | PTC Characteristic |
|---|---|---|---|
| Embodiment 6 | | | |
| 1 | 6.4 | $2.98 \times 10^9$ | 8.7 |

TABLE 5-continued

| Sample No. | Resistance (Ω) Room Temp. $R_{20° C.}$ | 150° C. $R_{150° C.}$ | PTC Characteristic |
|---|---|---|---|
| 2 | 6.9 | $5.71 \times 10^8$ | 7.9 |
| 3 | 7.7 | $5.25 \times 10^{10}$ | 9.8 |
| Comparison Example 4 | | | |
| 1 | $2.9 \times 10^{-2}$ | $1.43 \times 10^7$ | 8.7 |
| 2 | $2.8 \times 10^{-2}$ | $3.87 \times 10^8$ | 10.2 |
| 3 | $2.8 \times 10^{-2}$ | $1.16 \times 10^6$ | 7.6 |

As shown in Table 5, the PTC devices of Embodiment 6 exhibited PTC characteristic values similar to those of Comparison Example 4. In other words, when the terminals are connected to the electrodes, the aged PTC devices maintained their PTC characteristics even after dipping in solder at a temperature higher than 250° C., i.e., 360° C., because the dipping time is short. The conclusion is that PTC devices produced according to the present invention permit soldering to attach terminals to their electrodes.

In Embodiment 6, soldering was carried out by dipping, which subjects a device to a great thermal shock. Despite this thermal shock, PTC characteristics remained the same after the dipping. Therefore, PTC characteristics will also be maintained under reflow soldering or similar methods where temperature increases much more gently than with the dipping method. Consequently, PTC devices produced according to the present invention permit soldering to attach terminals to their electrodes.

As PTC elements according to claim 1 of the present invention have low resistivity, they are usable as overcurrent protection elements. When a body has been exposed to a high temperature similar to temperatures occurring in an actual surface mounting, the value of resistance remains virtually unchanged. And PTC characteristics are also maintained at the same level, with the PTC characteristic calculated from respective resistance values at room temperature and 150° C. showing no effect of aging. Therefore, PTC elements according to claim 1 of the present invention can be surface mounted without any change in their resistance at room temperature. Furthermore, a PTC device can be aged by subjecting it to a temperature higher than its peak resistance temperature for only a short time, from several minutes to some dozens of minutes, provided that the maximum temperature is lower than 250° C. and the pressure is normal. Thus the present invention increases throughput by shortening the aging process of the prior art.

PTC devices according to claim 2 of the present invention are PTC devices of claim 1 wherein terminals are attached to electrodes by spot welding. Therefore terminals can be easily attached to a device without heat damage to the body.

PTC devices according to claim 3 of the present invention are PTC devices of claim 1 wherein terminals are attached to electrodes by soldering. Therefore terminals can be easily attached to a device without danger of heat damage to the body. Furthermore, it is possible to maintain PTC characteristics of an device despite exposure during soldering to a temperature higher than the highest limit for aging, because the time required for soldering is short.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A method of making a PTC device, which comprises:

dispersing a plurality of conductive particles within an organic composition comprising at least one crystalline polymer having positive temperature coefficient characteristics;

forming a body by heating and pressure-molding said organic composition;

aging said body under normal pressure at a temperature no lower than a temperature where said body reaches its highest value of resistance;

attaching an upper electrode and a lower electrode to said body; and connecting at least one terminal to each of said upper electrode and said lower electrode.

2. A method of making a PTC device as in claim 1, wherein the step of connecting includes spot-welding.

3. A method of making a PTC device as in claim 1, wherein the step of connecting includes soldering.

4. A method of making a PTC device as in claim 1, wherein said at least one crystalline polymer includes polyethylene.

5. A method of making a PTC device as in claim 1, wherein the step of dispersing includes heating thermal black in a nitrogen atmosphere at 1000° C. for a period in the range from 13 to 18 hours to form said plurality of conductive particles.

6. A method of making a PTC device as in claim 1, wherein the step of dispersing includes crosslinking said at least one crystalline polymer.

7. A method of making a PTC device as in claim 6, wherein the step of crosslinking includes crosslinking by radiation.

8. A method of making a PTC device as in claim 1, wherein the step of attaching includes attaching a metal foil to serve as said upper electrode and said lower electrode.

9. A method of making a PTC device as in claim 1, wherein the step of aging said body includes heating at a temperature no higher than 250° C.

10. A method of making a PTC device, which comprises:

dispersing a plurality of conductive particles within an organic composition comprising at least one crystalline polymer having positive temperature coefficient characteristics;

forming a body by heating and pressure-molding said organic composition;

aging said body under normal pressure at a temperature no lower than a temperature where said body reaches its highest value of resistance and no higher than 250° C;

attaching a metal foil to said body to serve as an upper and a lower electrode; and connecting at least one terminal to each of said upper electrode and said lower electrode by one of spot-welding and soldering.

11. A method of making a PTC device as in claim 10, wherein said at least one crystalline polymer includes polyethylene.

* * * * *